United States Patent [19]

Miller et al.

[11] Patent Number: 4,879,829

[45] Date of Patent: Nov. 14, 1989

[54] FAST CARTRIDGE LOADER FOR FIREARM MAGAZINES

[76] Inventors: Michael K. Miller; Warren D. Stockton, both of 405 E. 19th St., Bakersfield, Calif. 93305

[21] Appl. No.: 266,575

[22] Filed: Nov. 3, 1988

[51] Int. Cl.[4] ..... F47B 39/06
[52] U.S. Cl. ..... 42/87
[58] Field of Search ..... 42/87, 88

[56] References Cited

U.S. PATENT DOCUMENTS

| | | | |
|---|---|---|---|
| 341,371 | 5/1886 | Bruce | 42/87 |
| 1,786,537 | 12/1930 | Holek | 42/87 |
| 2,402,195 | 6/1946 | Woodberry et al. | 42/87 |
| 2,451,521 | 10/1948 | Uglum | 42/87 |
| 4,739,572 | 4/1988 | Brandenburg | 42/87 |

OTHER PUBLICATIONS

"Guns", magazine, Apr. 1989, ¾ p., ad p.17 by Ram--Line, Inc.

"Firepower", magazine, Sep. 1987, full page ad. p.95 by Adventurer's Outpost.

*Primary Examiner*—Charles T. Jordan

*Attorney, Agent, or Firm*—Roylance, Abrams, Berdo & Goodman

[57] ABSTRACT

A loader particularly adapted for a cylindrical helical path feed ammunition magazine, the loader being able to accept cartridges as provided by the cartridge manufacturer in trays, whole trays at a time. The loader is made up of two hinged arms, with a platform on one of the arms to accept the tray of cartridges. After the tray is removed, the cartridges remain in the same array as they were in when in the tray, and then the arms are closed to create a dense mass of the large number of cartridges. The loader is then positioned vertically, a magazine inserted, and the cartridges quickly loaded into the magazine by turning a crank.

10 Claims, 3 Drawing Sheets

FAST CARTRIDGE LOADER FOR FIREARM MAGAZINES

CROSS REFERENCE TO RELATED PATENTS

This application is related to our co-pending U.S. patent application entitled "LARGE CAPACITY AMMUNITION MAGAZINE" filed Oct. 20, 1988 as U.S. Ser. No. 260,052, the entire disclosure of which is hereby incorporated by reference as if here set forth in full.

FIELD OF THE INVENTION

This invention relates to firearms; more in particular it relates to a device to rapidly load large numbers of cartridges into empty magazines for use in automatic and semi-automatic magazine fed firearms. This invention is particularly well adapted for use with the ammunition magazine of our above identified co-pending U.S. patent application.

BACKGROUND OF THE INVENTION

A key element in the development of firearms for warfare, public safety and personal defense is cartridge capacity. The number of times a gun can be fired without reloading is a critical measurement of it's effectiveness. The single shot muzzle loaders of the 18th century and the famous "six-shooter" revolver of the 19th century have been replaced by the 30+ shot magazine fed automatic rifles in current use. Our above identified related patent application describes a 100 round magazine which has possibly the largest capacity for a personal weapon yet designed. Although loading the magazines of modern weapons is a much more efficient process than that of their predecessors, loading a large number of cartridges is still a tedious process, especially when as many as 100 rounds must be loaded into a magazine.

This invention describes a loader with which a large number of cartridges can be quickly and easily transferred from their factory shipping containers into an appropriately configured firearm magazine. The preferred embodiment described herein transfers 50 cartridges from their container into a magazine in 15 seconds without the operator even handling the individual cartridges. The present invention is a significant improvement in the art of firearm magazine speed loaders, and is particularly well suited for use with the extremely large capacity magazine described in our above identified patent application.

SUMMARY AND ADVANTAGES OF THE INVENTION

The present invention teaches a mechanism for rapidly loading a large number of cartridges into magazines for automatic and semi-automatic magazine fed firearms. The invention comprises a smooth flat platform attached to one of two hinged together arms or appendages upon which a factory packaged tray of cartridges is placed. This platform is sized and shaped to accommodate the full tray of cartridges all at once. A longitudinally grooved, cylindrical rotor is rotationally mounted in the appendage with the platform. This rotor sequentially receives cartridges from the tray in it grooves and transfers them into the loading port of a magazine inserted endwise in an appropriately contoured socket of the invention loader. The invention also includes a spring loaded plunger which has a first leg which slides in a groove in the appendage with the platform, and a second leg which is intermittently contacted by the flutes of the rotor. This plunger is thus caused to reciprocate, to thus cyclically draw away from and interpose itself in the progression of the mass of cartridges on the tray. This prevents the cartridges from sticking, lodging or "bridging" as they move towards the rotor on the tray.

The invention is particularly suited to load cartridges which are relatively short (i.e. 9 mm pistol cartridges) and which are packaged in plastic or styrofoam trays that loosely hold the cartridges nose down in a rectangular matrix. In the preferred embodiment of the invention, a tray of 50 cartridges is positioned on the platform and the tray is then removed, leaving the cartridges standing free in an array on the platform. The hinged appendages of the invention are then closed, pinching the loose mass of cartridges together until the appendages latch together. The cartridges are then snugly contained within a minimum space between the appendages. An appropriately configured magazine is then inserted into the "socket" of the invention. As the operator rotates the handle attached to the rotor, the cartridges are sequentially caught in the grooves of the rotor and inserted through the loading port of the magazine.

The preferred embodiment of the invention is constructed almost entirely of injected thermoplastic material, but the described mechanism and technique of orienting the cartridges into a dense mass of loose cartridges and inserting them into a magazine one by one in orderly progression is not limited to any specific material or type of cartridge or magazine.

The invention makes use of the force of gravity to feed the mass of cartridges down along the tray and into the rotor. This gravity feed feature simplifies the apparatus by avoiding biasing means and the like, and also tends to produce a more reliable loader.

Another feature of the invention is the provision of means such as interfitting grooves and ridges and/or mating flats to hold the magazine being loaded stationary against rotation about its own axis as the invention loader inserts the cartridges into the magazine.

Thus the invention provides an improved loader to quickly load large numbers of cartridges into specific types of magazines, which loader is particularly adapted for rugged field use, which is made of rugged materials, which is simple in its operation and manufacturer, and which has numerous features and advantages which will present themselves to those skilled in the art from a detailed study of the following description and drawings.

BRIEF DESCRIPTION OF THE FIGURES OF THE DRAWING

This invention will be best understood when the description is read in conjunction with the attached drawings, which drawings also form a part of this disclosure, and in which.

DETAILED DESCRIPTION OF THE PREFERRED EMBODIMENTS

Figure 1:
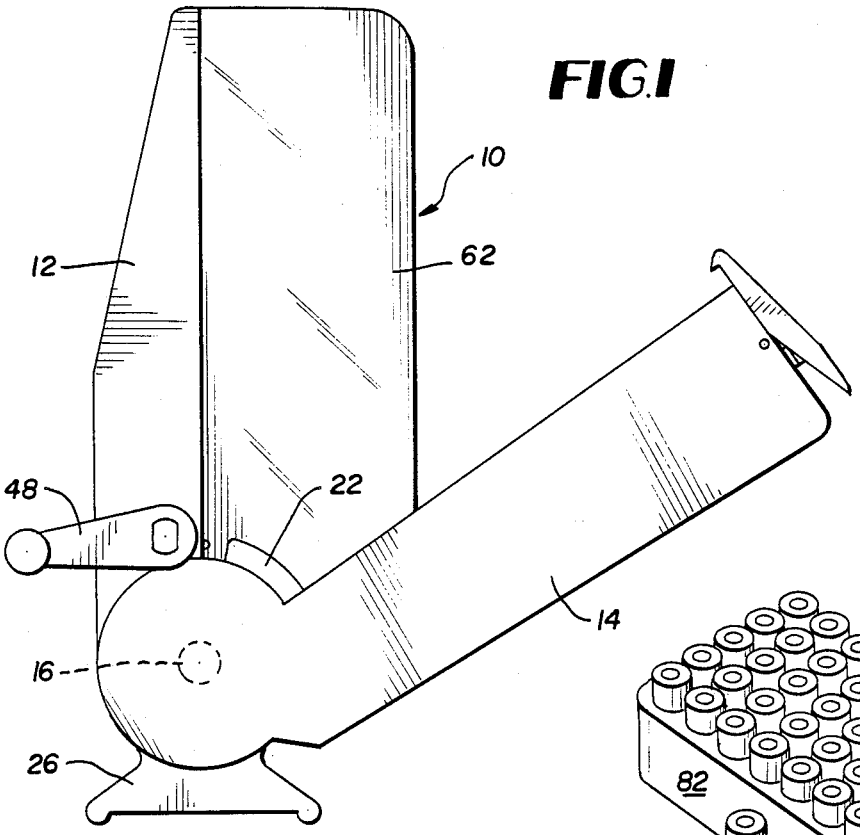
FIG. 1 is a front elevational view of the loader of the invention shown with its legs in an open position.

The invention loader 10 comprises a pair of arms 12 and 14 which are hinged together on a pin 16. Pin 16 is integral with the arm 14 and mates into a suitably formed opening 18 in arm 12. Pin 16 is held in place for rotational motion about its own axis by means of a snap ring 20. In addition to the pin 16 and hole 18, the motion of the two arms 12 and 14 about the axis of the pin is further guided by a ridge or finger 22 formed on the arm 12 which slidely mates with a companion curved groove 24 formed in the arm 14.

The two main parts 12 and 14 of the invention loader 10, as well as many of the other parts described below, are preferably made of injection molded plastic materials to achieve the advantages of low cost of manufacture, close control of physical properties, light weight, ruggedness in use, and other known advantages.

Figure 4:
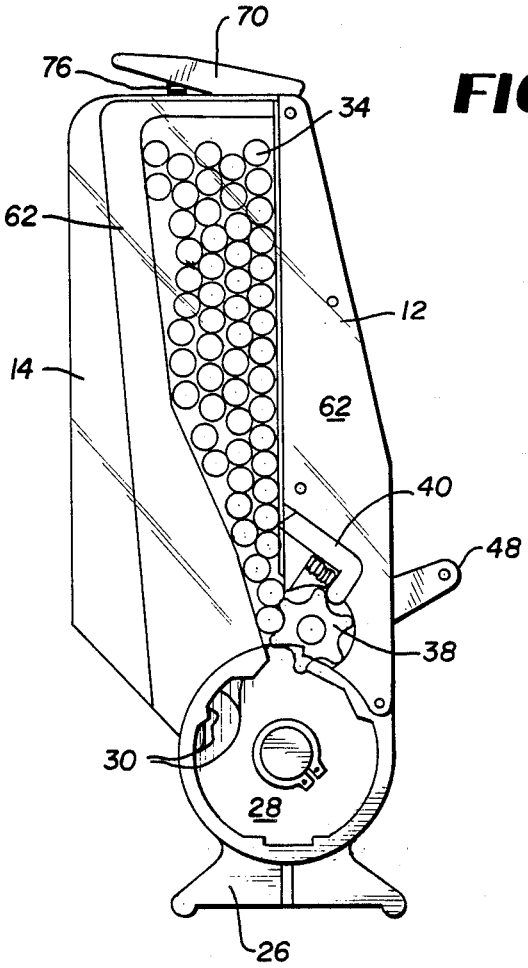
FIG. 4 is a front elevational view similar to FIG. 1 but reversed front to rear and showing the loader with the tray of cartridges therein and ready to load a magazine.
Figure 5:
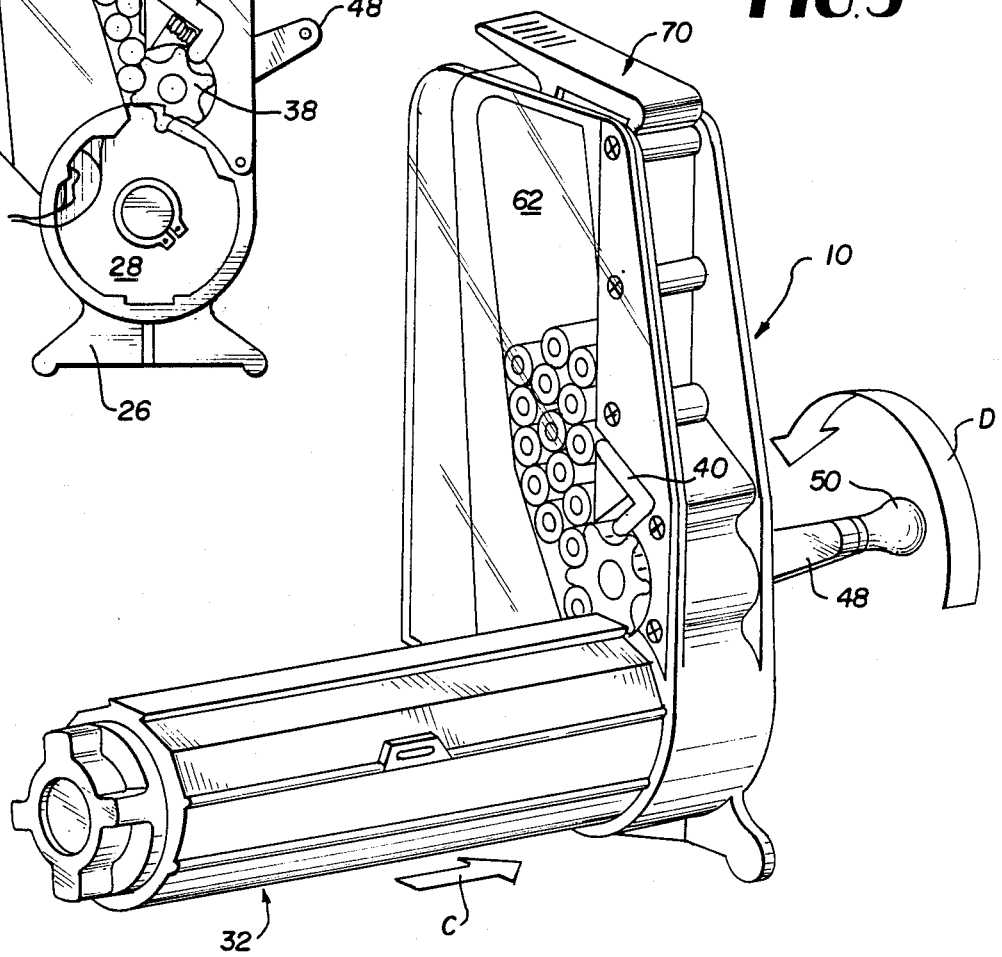
FIG. 5 is a perspective view similar to FIG. 4 but showing the magazine inserted into the invention loader and showing the act of the cartridges being loaded into the magazine.

Arm 12 is formed with a foot portion 26 to facilitate the invention loader 10 standing upright in use, as shown in FIGS. 4 and 5. Arm 12 is also forced with a socket 28 which is formed with a plurality of grooves, ridges, and asymmetrical portions 30 formed along its walls. A magazine 32 has similar mating grooves, ridges and asymmetrical portions in order to orient the magazine 32 properly in the invention loader 10 for loading of the cartridges 34 into the magazine. Reference should be had to our above identified co-pending patent application for details of this magazine 32. While the invention was designed for use with this particular magazine 32 and for the 9 mm pistol or short cartridge, it will be readily understood that the invention loader can be readily modified, and in fact must be modified, for use with other sizes of cartridges and/or other configurations of magazines analogous to magazine 32.

Thus, it can be seen that these grooves, ridges, and the like, in cooperation with mating means on the magazine 32, together comprise interfitting means adapted to prevent rotation of the magazine 32 about its own axis when it is located in the socket 28.

The invention loader also comprises means to feed a solid mass of cartridges through itself and into magazine 32 one by one in an orderly progression while preventing any jamming, bridging or the like disruption of this orderly feeding of the cartridges. To this end, arm 12 is formed with a composite opening 36, having a rotor 38 mounted in the front curved portion thereof and a feed plunger 40 mounted in the back portion.

The rotor 38 includes a plurality of flutes 42 which run parallel to the axis and lengthwise of the rotor. The rotor 38 further includes a pair of end pins 44 and 46. The end pin 46 is formed with a pair of flats to mate with the socket portion of a direct drive handle 48. Handle 48 further includes a loosely mounted rotational knob 50 which is held in place on a suitable pin on the outer end of the handle 48 by a securing screw or rivet or the like 52. The composite opening 36 is formed with an opening 54 to rotationally pass the rotor end pin 46, with the handle mounted outboard thereof as shown in FIG. 1, for example.

Plunger 40 comprises a long leg 56 and a shorter leg 58, the two legs making approximately a right angle with respect to each other. A spring 60 bears against a suitably formed opening on the inside of the short leg 58 and its other end bears against a suitable wall of arm 12 in composite opening 36. In this manner, the plunger 40 is normally biased downwardly and to the right as it appears in FIGS. 4 and 5. The outer end of the short leg 58 contacts the tops of the flutes 42 of the rotor 38 repeatedly as it rotates, for a reason which will appear below.

A platform member 62 is secured to the arm 12 by means of a plurality of screws or the like fasteners 64. This platform is preferably made of a tough rugged clear plastic material, for a reason which will appear below. The platform 62 is formed with a cut out portion 66 shaped to fit around the outside of the socket 28 in order to allow clearance for insertion of the magazine 32. The platform 62 is formed with an opening 68 to rotationally mount the other end pin 44 of the rotor 38.

Figure 6:
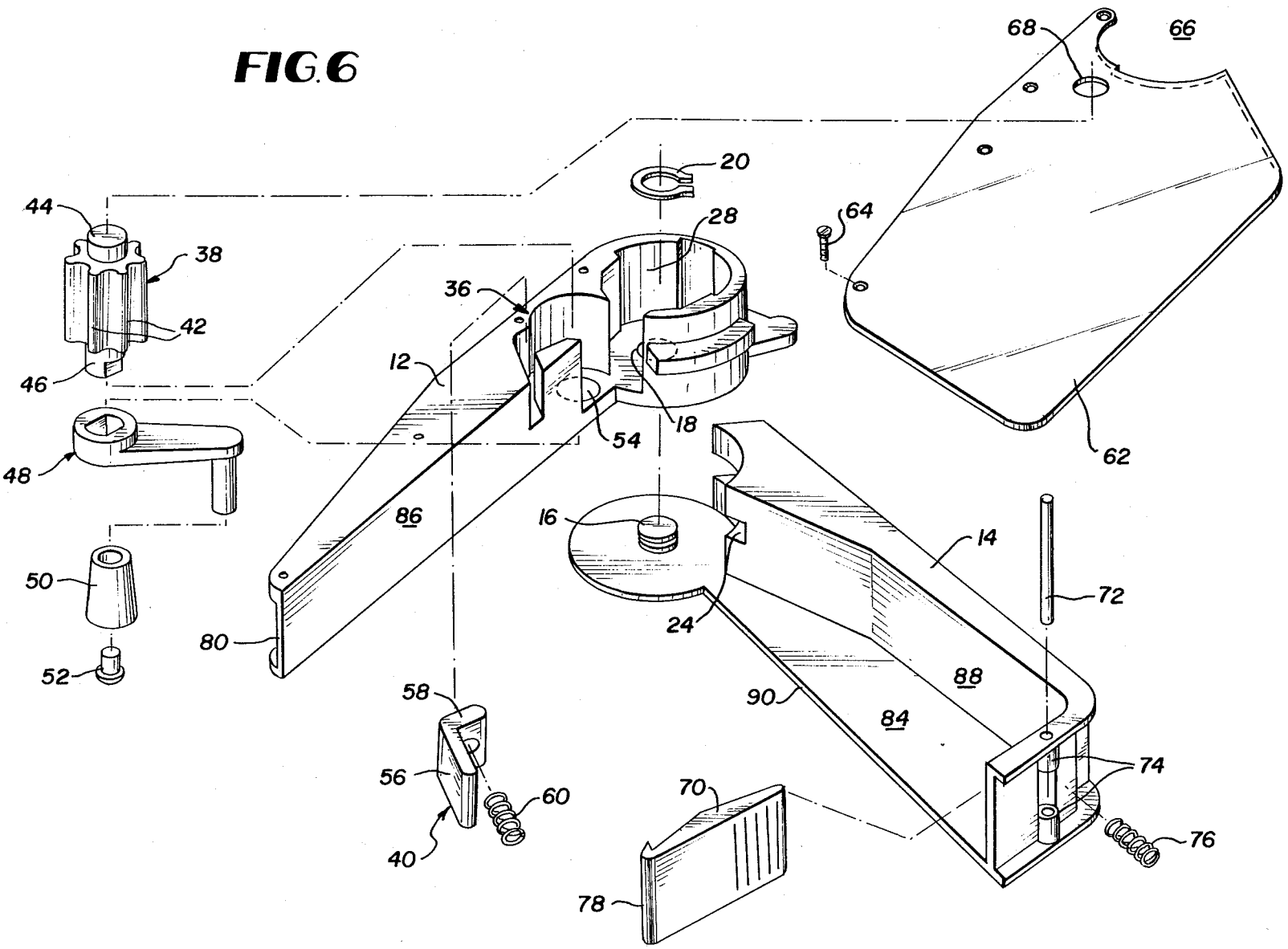
FIG. 6 is an exploded perspective view of the invention loader.

Means are provided to hold the arms 12 and 14 in closed latched together condition as shown in FIGS. 4 and 5 when the loader is full of the cartridges 34 to be loaded into the magazine 32. To this end, referring especially to FIG. 6, a latch member 70 is pivotally mounted by means of a pin 72 in the end of the arm 14, and a spring 76 normally biases the end 78 of the latch into mating engagement with a corresponding portion 80 formed at the end of the companion arm 12. Bosses 74 are formed in the outer end of the arm 14 to securely mount the pin 72 on which the latch 70 is mounted. The end of the latch 70 opposite the engaging part 78 is formed with grooves or knurls for cooperation with a finger of a user, in the conventional manner. The operation of latch 70 is obvious from FIGS. 4 and 5.

Figure 2:
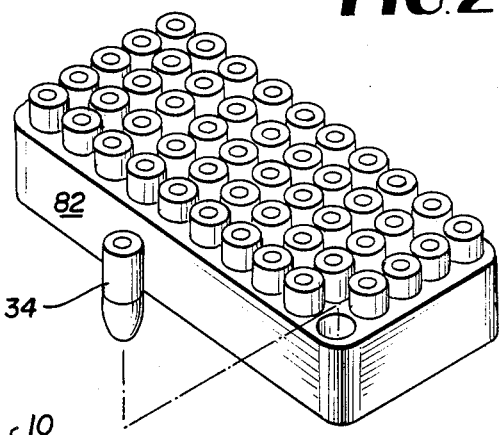
FIG. 2 is a perspective view of a typical tray of cartridges which the invention is particularly well adapted to use.

In FIG. 2 there is shown a tray 82 in which a plurality of cartridges are loaded by the cartridge manufacturer. These trays are usually "throw away" items made of styrofoam or the like inexpensive material. The cartridges are preferably loaded therein in a rectangular matrix, $5 \times 10$, in the example shown in FIG. 2, which is typical for 9 mm pistol or short rounds for which the particular embodiment shown in the drawings has been designed.

However, while the loading of magazines 32 using the invention loader 10 is simplified when a tray such as 82 in which cartridges 34 are mounted face down is the beginning point, the invention can just as well be used, as is common in military or other volume shooting environments, where the cartridges 32 are packed in large quantities loosely as in wooden crates. In such case, the user will simply hold the invention loader as shown in FIG. 1, perhaps at a 45° angle and tilted to the left, and then will load the cartridges 34 onto the tray 62 until a condition such as is shown in FIG. 4 is obtained. This is considerably faster than loading the cartridges one by one into the magazine, although more time consuming then when full trays such as 82 of FIG. 2 are available. Thus, the invention is not limited to use with such trays 82, but is only advantageously used therewith, and the platform 62 is so designed for the tray 82. For a different size of cartridges, the platform 62 will be configured accordingly, that is, to match the trays in which such different size cartridges are normally provided by the manufacturer. This is part of configuring the size of the entire loader 10 to match a particular size of cartridge as well as a particular magazine.

The platform 62 is preferably, although not necessarily, made of a tough clear plastic material. With this "see through" advantage, the user can tell when he has finished loading all of the cartridges, as in FIG. 5, by looking through the platform 62. Further, the user can observe the operation of the rotor 38 and the plunger 40 to quickly detect any malfunction, breakage, wear, or the like in the invention loader.

Figure 3:
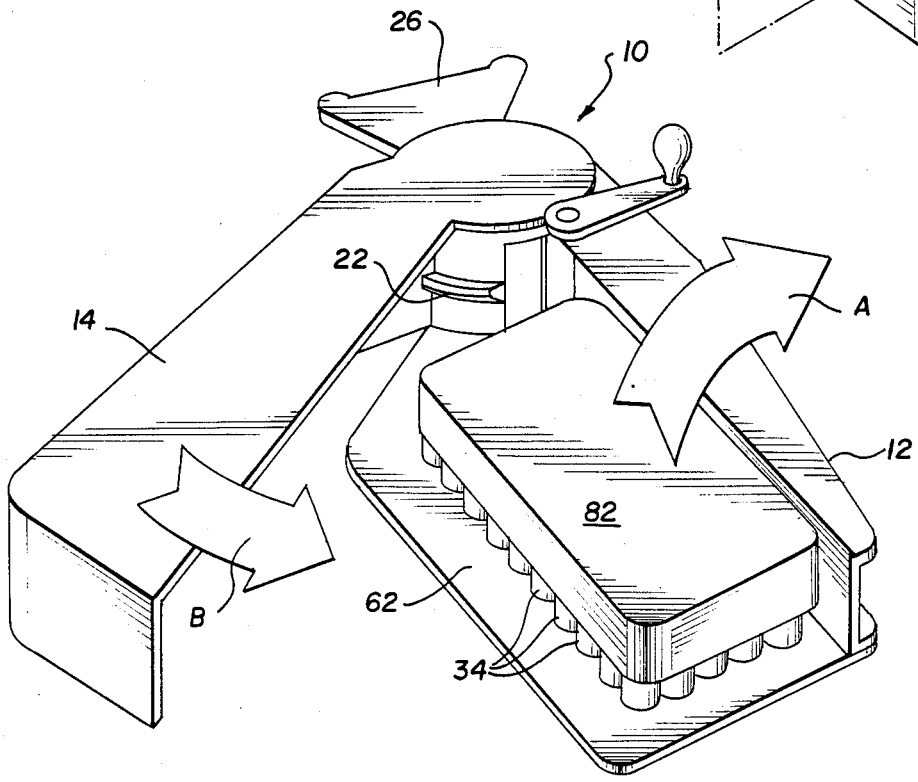
FIG. 3 is a perspective view showing the action of the beginning of use of the invention to load a tray of cartridges of FIG. 2.

In use, the tray 82 full of 50 cartridges 34 is put onto the platform 62 upside down. This is readily accomplished with the light weight of the invention loader 10 by bringing them together in a vertical plane or bringing the platform 62 to the tray 82 with the tray in the position shown in FIG. 2 and then putting the parts in the position shown in FIG. 3. Next, the tray 82 itself, empty of the cartridges 34, is lifted off carefully so as to not upset the arrangement of the cartridges as they now stand freely on the platform 62. The arrow A indicates the removal of the empty tray 82. Next, as indicated by the arrow B, the two legs 12 and 14 are brought together and the latch 70 is closed. The loader with the mass of cartridges 34 is then put in a vertical upright position as shown in FIG. 4. The latch 70 has been omitted in FIG. 3 for the sake of clarity.

Next, the magazine 32 is inserted into the socket 28 as indicated by the arrow C. Then, the mass of cartridges, 50 in the case of 9 mm pistol or short rounds, are quickly inserted into the magazine by turning the crank 48 as indicated by the arrow D. With the insertion of each cartridge, each one being captured in a flute 42, each ridge between each two flutes acts against the end of the short arm 58 of the plunger 50. The rotation in the direction of arrow D then forces the plunger 40 upwardly and to the left as indicated in FIG. 5 so that the outer end of the long arm 56 interposes itself into the mass of the cartridges 34 between the arms 12 and 14. Long arm 56 is shown partially extended in FIG. 4 and entirely retracted in FIG. 5. This action, with the loading of each cartridge, of the end of the arm 56 of plunger 40 into the mass of cartridges, keeps them moving downwardly by the force of gravity in an orderly manner to finally approach the flutes of the rotor 38 one by one to be inserted into the magazine 32 one by one. All possibility of a cartridge bridging the opening, jamming, or the like, is avoided by the action of the plunger 40 as described above.

The desirable feature of making the platform 62 transparent is now clear, since the user can observe the progression of the cartridges downwardly into the rotor, and can observe the normal operation of the plunger 40. Likewise, the user will immediately see any jam or disfunction of the loader 10.

Arm 14 is formed with a flat wall 84 which, in the closed position of the arms 12 and 14 as shown in FIGS. 4 and 5, will be positioned opposite and parallel to the platform 62. Thus, it can be seen that when the arms are joined together by the latch 70/80 the walls 84 and 62 will be spaced apart from each other defining a narrow space shown best in FIG. 4, of predetermined volume adapted to contain a predetermined number of cartridges 34. In the preferred embodiment, this number is 50 cartridges, since that is the number typically available in the trays 82 of FIG. 2. Thus, with the side walls 86 and 88 of arms 12 and 14, respectively, in spaced relation to each other and with the back and front walls 84 and 62 in predetermined spaced relation to each other, a volume is defined in the latched condition of the loader 10 of predetermined size to contain a mass of cartridges of a predetermined number. The only freedom these cartridges have for movement when the loader is oriented in its normal vertical position for loading the magazine 32, is straight down into the cartridge inserting means, in the form of rotor 38, located at the bottom of this space and in closely spaced relation to the cartridge 32.

As shown in FIGS. 1 and 4 respectively, the two arms 12 and 14 hinge about the axis of the pin 16. They are confined to an open position adapted for loading as shown in FIG. 1, and a closed latch position for loading the cartridges into the magazine as shown in FIG. 4. Stop means, not shown, are provided between the arms 12 and 14 to define the open position of FIG. 1. The closed position is defined by the edge surface 90 of arm 14 striking against the side wall 86 of arm 12.

While the invention was developed specifically for and is particular adapted for use with the large capacity magazine of our co-pending patent application identified above, it will be evident to those skilled in the art that it can be used with other types of magazines. Modification of the socket 28 to cooperate with any other sort of magazine with the cartridge receiving opening of the magazine suitably orientated with respect to the rotor 38 in order to insert cartridges into any such other magazine, is well within the teaching of the present invention. Thus, the word "magazine" as used in the specification and claims herein shall be understood to mean any such magazine, and not only the specific magazine of our prior co-pending patent application.

The invention achieves a dramatic step forward in the art of loading large numbers of cartridges into magazines, and in particular into the magazine of our co-pending patent application described above. Using 9 mm pistol rounds, the invention has been able to load 50 cartridges from their tray, through the loader and into the magazine in only 15 seconds. This is an unheard of improvement in speed of loading an ammunition magazine.

While the invention has been described in some detail above, it is to be understood that this detailed description is by way of example only, and the protection granted is to be limited only within the spirit of the invention and the scope of the following claims.

What is claimed is:

1. In combination, a loader for a cartridge magazine, said magazine comprising means to receive cartridges of a predetermined size and to load said magazine with said cartridges, said loader comprising cartridge inserting means adapted to urge said cartridges one by one from said loader via said magazine cartridge receiving means into said magazine, said loader further comprising a first arm and a second arm, a cartridge platform fixed to one of said arms, a back wall joined to the other of said arms and positioned substantially parallel to said platform, said back wall and said platform being spaced apart from each other by a distance at least equal to the length of one of said cartridges of said predetermined size, means to hinge said arms to each other for motion on an axis substantially perpendicular to said platform and to said back wall, stop means defining a closed position and an open position of said arms with respect to each other, each of said arms also comprising a side wall, said loader being adapted to accept cartridges on said platform in said open position of said arms; said platform, said back wall, and said side walls on said arms all together in said closed position of said arms defining a predetermined volume at least equal to the volume of a relatively dense mass of a predetermined number of said cartridges of said predetermined size; said loader with said mass of cartridges in said predetermined volume being in a predetermined orientation with respect to the force of gravity when loading said cartridges into said magazine, and said loader comprising means to removably mount said magazine to be loaded with said cartridges in said loader with said magazine cartridge receiving means in a predetermined closely spaced relation to and below said loader's cartridge inserting means, whereby said mass of cartridges are fed through said loader and into said cartridge inserting means by the force of gravity.

2. The combination of a claim 1, said loader, said arms and said predetermined volume, when said loader is in said predetermined cartridge loading orientation with respect to gravity, all being of generally horizontally thin and vertically elongated shapes, said hinge means and said magazine mounting means both being located at the lower end of said loader, manual latch means to removably hold said arms in said closed position, and said latch means being at the upper ends of said arms.

3. The combination of claim 2, and foot means at the lower end of said loader to facilitate use of said loader when said loader is in said predetermined cartridge loading orientation with respect to gravity.

4. The combination of claim 1, said platform consisting of a sheet of transparent material, whereby said mass of cartridges in said volume can be observed as they are loaded into said magazine.

5. The combination of claim 4, wherein said predetermined number of said cartridges are provided by the cartridge manufacturer packed in a tray, and said platform when in said open position of said arms being large enough to accept all of at least one of said trays of cartridges, whereby upon removal of said tray said cartridges will remain on said platform retaining the arrangement they had with respect to each other when they were in said tray and whereby upon moving said arms into said closed position said cartridges will be moved from said tray arrangement into said relatively dense mass of said cartridges.

6. The combination of claim 1, said loader further comprising means for causing an orderly movement of said cartridges downwardly through said volume and into said cartridge inserting means, said cartridge movement means comprising plunger means, means to mount said plunger means in one of said arms in closely spaced relation above said cartridge inserting means and for motion between a first position and a second position, said plunger means when in said first position being substantially entirely contained within said one of said arms, said plunger means when in a said second position having a portion thereof intruding into said predetermined volume and into said mass of said cartridges when said cartridges are therein, spring means normally urging said plunger means to said first position, and said plunger means comprising means cooperable with said cartridge inserting means to cause said plunger means to move between said first and second positions together with and in a predetermined relationship with the operation of said cartridge inserting means.

7. The combination of claim 1, said cartridge inserting means comprising a fluted rotor, each of the flutes of said rotor being of a size and shape to accept one only of said cartridges, means to mount said rotor in said loader for rotation about a horizontal axis when said loader is in said cartridge loading orientation with respect to gravity, and hand crank means attached to said rotor and positioned outside said volume and in closely spaced relation to one of said platform and said back wall.

8. The combination of claim 7, said loader further comprising means for causing an orderly movement of said cartridges downwardly through said volume and into said cartridge inserting means, said cartridge movement means comprising plunger means, means to mount said plunger means in one of said arms in closely spaced relation above said cartridge inserting means and for motion between a first position and a second position, said plunger means when in said first position being substantially entirely contained within said one of said arms, said plunger means when in said second position having a portion thereof intruding into said predetermined volume and into said mass of said cartridges when said cartridges are therein, spring means normally urging said plunger means to said first position, and said plunger means having a portion normally urged by said spring means into contact with said fluted rotor, whereby said plunger means moves between said first and second positions in response to rotational motion of said rotor by each distance corresponding to a single flute.

9. The combination of claim 1, said magazine being of a generally cylindrical configuration and receiving said cartridges therein in a helical pattern with their axes generally parallel to the axis of said magazine, said magazine cartridge receiving means being located at one end of said magazine, said magazine removable mounting means comprising socket means formed in said loader for receiving the end of said magazine with said cartridge receiving means therein, said removable mounting means further comprising interfitting means on both the inside wall of said socket means and the outside of at least said end of said magazine, whereby once inserted in said socket means with said cartridge receiving means in said predetermined closely spaced relation to said loader cartridge inserting means said magazine is restrained by said interfitting means against rotation about its own axis in said socket means.

10. The combination 9, said axis on which said arms are hinged to each other being substantially coincident with the axis of said socket means.

* * * * *